US008468749B1

(12) United States Patent
Dufresne

(10) Patent No.: US 8,468,749 B1
(45) Date of Patent: Jun. 25, 2013

(54) GATE ENTRY SYSTEM

(75) Inventor: Peter Dufresne, Phoenix, AZ (US)

(73) Assignee: Margaret Dufresne, Sun City West, AZ (US)

( * ) Notice: Subject to any disclaimer, the term of this patent is extended or adjusted under 35 U.S.C. 154(b) by 0 days.

(21) Appl. No.: 13/609,074

(22) Filed: Sep. 10, 2012

Related U.S. Application Data

(60) Provisional application No. 61/532,870, filed on Sep. 9, 2011, provisional application No. 61/532,889, filed on Sep. 9, 2011, provisional application No. 61/532,907, filed on Sep. 9, 2011, provisional application No. 61/532,863, filed on Sep. 9, 2011.

(51) Int. Cl.
*E06B 11/02* (2006.01)

(52) U.S. Cl.
USPC ..... 49/404; 49/360; 49/425; 49/324

(58) Field of Classification Search
USPC ..... 49/360, 324, 404, 410, 411, 415, 49/420, 425
See application file for complete search history.

(56) References Cited

U.S. PATENT DOCUMENTS

| | | | | | |
|---|---|---|---|---|---|
| 2,346,388 | A * | 4/1944 | Peebles | 49/360 |
| 2,752,150 | A * | 6/1956 | Richmond et al. | 49/28 |
| 3,826,043 | A | 7/1974 | Seng | |
| 4,065,878 | A | 1/1978 | Tsugane | |
| 4,723,374 | A * | 2/1988 | Peterson et al. | 49/404 |
| 4,791,757 | A * | 12/1988 | Orlando | 49/360 |
| 4,858,383 | A | 8/1989 | Kendig | |
| 5,136,813 | A * | 8/1992 | Gibbs et al. | 49/404 |
| 5,220,746 | A * | 6/1993 | Yeager | 49/360 |
| 5,261,187 | A * | 11/1993 | Prenger | 49/362 |
| 5,680,729 | A * | 10/1997 | Heffington | 49/362 |
| 2006/0144529 | A1 | 7/2006 | Hemphill | |
| 2006/0150520 | A1 * | 7/2006 | Hamazaki | 49/449 |
| 2010/0024307 | A1 * | 2/2010 | Dale et al. | 49/360 |
| 2011/0265382 | A1 * | 11/2011 | Timmermann | 49/31 |

* cited by examiner

*Primary Examiner* — Katherine Mitchell
*Assistant Examiner* — Abe Massad
(74) *Attorney, Agent, or Firm* — Booth Udall Fuller. PLC

(57) ABSTRACT

A gate entry system that includes a gate and a gate drive system mounted to a gate post and including a drive roller and a passive roller is disclosed. In specific implementations of the gate entry system, extension rollers may be removably coupled to one or both of the drive roller and passive roller. Opposing sides of the gate may be in constant direct contact with the drive roller (or any extensions coupled thereto) and the passive roller (or any extensions coupled thereto). Rotation of the drive roller when the gate is between the passive roller and drive roller acts to move the gate in a linear direction. The drive roller may include a shaft coupler and a threaded female coupling opposite the shaft coupler. A threaded male coupling of an extension roller may be threadedly coupled to the drive roller threaded female coupling.

19 Claims, 11 Drawing Sheets

GATE ENTRY SYSTEM

CROSS REFERENCE TO RELATED APPLICATIONS

This document claims the benefit of the filing date of U.S. Provisional Patent Applications 61/532,870, entitled "Gate Entry System" to Peter Dufresne that was filed on Sep. 9, 2011, 61/532,889, entitled "Gate Entry System" to Peter Dufresne that was filed on Sep. 9, 2011, 61/532,907, entitled "Gate Entry System" to Peter Dufresne that was filed on Sep. 9, 2011, and 61/532,863, entitled "Gate Entry System" to Peter Dufresne that was filed on Sep. 9, 2011, the contents of each of which are hereby incorporated by reference.

BACKGROUND

1. Technical Field

Aspects of this document relate generally to gate entry systems and gate rollers.

2. Background Art

Various gate entry and control systems are often utilized in both industrial and consumer settings. Conventional gate entry systems, however, have multiple problems inherent in the design of the gate entry or control system. First, conventional gate entry systems pose a safety risk. Typical chain or gear gate opening/closing systems provide opportunity for fingers, arms, legs, or other bodily parts to be crushed or smashed in the gate movement operators as the gate opens. Second, the ability to move the gate through its full range of motion for a conventional bar welded to the side of the frame-type of conventional gate system is reduced or eliminated if the gate is on an incline.

SUMMARY

Aspects of the present disclosure relate to a gate entry system, comprising a gate comprising a first horizontal side, and a second horizontal side opposite the first horizontal side, the first and second horizontal sides separated by a top side at an upper end and a bottom side at a lower end, the bottom side comprising at least one support wheel between the bottom side and a ground surface, and a gate drive system stationarily positioned relative to a gate post and comprising a roller mount coupled to the gate post, a first roller coupled to the roller mount and in direct contact with the first horizontal side, a second roller coupled to the roller mount and in direct contact with the second horizontal side, wherein at least one of the first roller and the second roller is a drive roller responsive to at least one motor that rotatably drives the drive roller against the respective first or second horizontal side of the gate such that the gate moves linearly in response to the drive roller movement.

Particular embodiments and implementations may comprise one or more of the following features. One of the first roller and the second roller may be a passive roller, not rotatably driven by a drive motor, that passively rotates as the gate moves linearly in response to the drive roller movement. Both the first roller and the second roller may each be drive rollers responsive to the at least one motor that rotatably drives the drive rollers. Each of the first roller and the second roller may comprise at least one extension roller mechanically coupled to a distal end of the respective rollers such that rotation of the respective first and second rollers rotates the at least one extension roller coupled thereto, wherein at least one of the first roller and its at least one extension is in direct contact with the first horizontal side when the gate moves and at least one of the second roller and its at least one extension is in direct contact with the second horizontal side when the gate moves. The at least one extension roller may be coupled to the first roller through a threaded coupling. The threaded coupling may comprise a threaded female coupling on an inside surface of the distal end of the first roller and a threaded male coupling on an outside surface of an end of the at least one extension roller coupled thereto. The threaded coupling may comprise a threaded female aperture on at least one of the first roller and the at least one extension roller, and a threaded screw coupled with the threaded female aperture. The gate drive system may further comprise at least one gear housed in the roller mount, the at least one gear rotatably responsive to the motor and configured to rotate the drive. The at least one support wheel may be at least one guide wheel configured to remain coupled with a guide wheel track as the gate moves linearly. The roller mount may be coupled to the gate post above the gate adjacent the top surface, and the first roller and the second roller extend below the roller mount. The roller mount may be coupled to the gate post below the gate adjacent to the bottom surface, and the first roller and the second roller extend above the roller mount.

Another aspect of the disclosure relates to an apparatus for moving a gate through direct contact with the gate, comprising a cylindrical drive roller comprising a shaft coupler and a threaded female coupling opposite the shaft coupler on an inside surface, and a cylindrical first extension roller comprising a first extension threaded male coupling, wherein the extension roller is coupled to the drive roller through the threaded female coupling of the cylindrical driver and the first extension threaded male coupling of the extension roller.

Particular implementations and embodiments may comprise one or more of the following features. A cylindrical second extension roller may be coupled to the first extension roller through a second extension male coupling on the second extension roller and a first extension threaded female coupling on the first extension roller opposite the first extension threaded male coupling. The shaft coupler may comprise a shaft collar coupled to the cylindrical drive roller, the shaft collar comprising a shaft passage and a first coupling channel. The shaft coupler may be coupled to the drive roller with at least one set screw. A drive shaft may be coupled to the shaft collar and extending through the passage of the shaft collar, the drive shaft comprising a body sized to fit within the passage, a head larger than the passage, and a second coupling channel on the body. A rod may be placed within first and second channels when the first and second channels are in an aligned position.

According to another aspect, an apparatus for supporting a gate through direct contact with the gate may comprise a cylindrical passive roller comprising a bolt coupling, a female coupling opposite the bolt coupling, and at least one first set screw hole on the female coupling, and a cylindrical first extension roller comprising a first extension male coupling within the female coupling of the passive roller and comprising at least one second set screw hole, wherein a set screw threadedly engaged with the first set screw hole and the second set screw hole couples the passive roller to the first extension roller.

Particular implementations and embodiments may comprise one or more of the following features. The bolt fastener may comprise at least one bearing coupled to an interior surface of the cylindrical passive roller between two snap rings, the bearing comprising a void sized allow passage of a bolt shaft of a bolt through the void.

According to another aspect, a gate roller system may comprise a first gate roller comprising a first passage through the first gate roller, a first bolt comprising a first bolt shaft body that passes through the first passage of the first gate roller, a first bolt head, and a first roller mount coupling opposite the head, wherein the first bolt head comprises a first female threaded coupling and a first hex key receiver within the first female threaded coupling, a second gate roller comprising a second passage through the second gate roller, and a second bolt coupled to the first bolt and comprising a second bolt shaft body that passes through the second passage of the second gate roller, a second bolt head, a male threaded coupling opposite the second bolt head and threadedly coupled to the first female threaded coupling, wherein the second bolt head comprises a second female threaded coupling and a second hex key receiver within the second female threaded coupling.

Particular implementations and embodiments may comprise one or more of the following features. The first bolt may further comprise a first coupling channel. The gate roller system may further comprise a shaft collar coupled to the first gate roller, the shaft collar comprising a collar passage and a second coupling channel aligned with the first coupling channel. A rod may exist within the aligned first and second coupling channels.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended gate entry system, gate rollers and/or assembly procedures for a gate entry system or gate rollers will become apparent for use with implementations of gate entry systems and gate rollers from this disclosure. Accordingly, for example, although particular gate entry systems and gate rollers disclosed, such gate entry systems and gate rollers and implementing components may comprise any shape, size, style, type, model, version, measurement, concentration, material, quantity, and/or the like as is known in the art for such gate entry systems and gate rollers and implementing components, consistent with the intended operation of gate entry systems and gate rollers.

Figure 1:
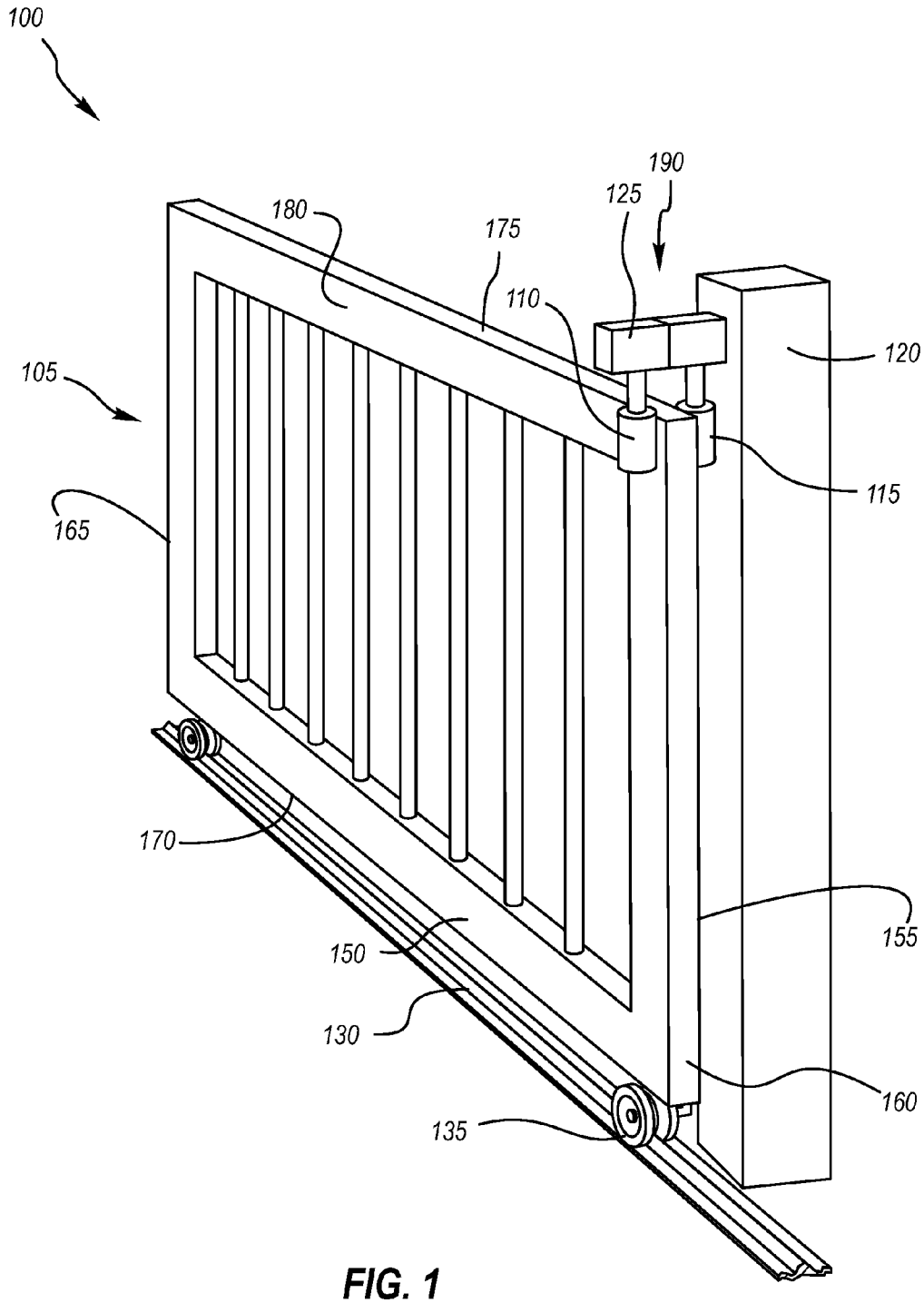
FIG. 1 is a perspective view of a first implementation of a gate entry system.

Referring to FIG. 1, an embodiment of a gate entry system 100 may comprise a gate 105, a gate post 120, and a stationary gate drive system 190 comprising a roller mount 125 and a plurality of rollers 110, 115. In the implementation pictured, the gate 105 comprises a first horizontal side 150, a second horizontal side 155 opposite the first horizontal side 150, and a top side 175, bottom side 170, and two vertical sides 160, 165 between the first horizontal side 150 and the second horizontal side 155. As used herein, the terms "horizontal" and "vertical" are not intended to indicate any particular angle with respect to any particular reference point, but are intended only to provide a differentiating name for various sides with respect to their general orientation.

The gate 105 may comprise a variety of materials known in the art, such as but not limited to various types of metals, alloys, woods, and/or plastics. Various implementations of the gate entry system may comprise a gate 105 with continuous first 150 and second 155 sides, while other implementation may comprise first 150 and second sides 155 with openings, slats, or the like. In an embodiment, the rollers 110, 115, 205 may move the gate 105 by direct contact with the front horizontal side 150 and/or second horizontal side 155.

The first horizontal side 150 may further comprise a first contacting surface 180, and the second horizontal side 155 may further comprise a second contacting surface 185. The contacting surfaces 180, 185 may comprise a material directly applied to any portion of the first 150 or second horizontal sides that increases friction or traction between the rollers 110, 115 and the gate 105. The contacting surfaces 180, 185 may be located anywhere on the first horizontal 150 and second horizontal 155 sides of the gate where the rollers 110, 115 engage with the contacting surfaces 180, 185. In the implementation pictured in FIG. 1, the contacting surface 180, 185 are proximate to the top side 175 of the gate 105. In other implementations, the contacting surfaces 180, 185 may be proximate to the bottom side 170 of the gate 105. In still other implementations, the contacting surfaces 180, 185 may be near the middle of the gate 105. Placement of the contacting surfaces proximate the top side 175 of the gate provides particular advantage because it keeps the rollers 110, 115 up and out of reach of children, and allows for mounting of the rollers. Furthermore, other implementations of the gate 105 may comprise additional support bars or beams coupled to gate 105 that may comprise contacting surfaces 180, 185.

An implementation of the gate entry system 100 may further comprise a gate post 120. The gate post may be coupled to the roller mount 125 and act as a stabilizer or support for the roller mount and/or the gate 105. In other implementations, the roller mount may be coupled other fixed or stationary objects, such as but not limited to walls, fences, poles, and the like. The gate post 105 may, according to an implementation, comprise a post cabinet. The post cabinet may comprise the controls and/or motors for the gate entry system 100, traditionally found outside the gate in a separate cabinet. The post cabinet may comprise a D/C motor, a control board, a gear box, and batteries. In a particular implementation, the post cabinet comprises an electric plug and cord that charges the batteries. In other implementations, the gate entry system 100 may function without batteries, and run power supplied by the electric plug and the cord. In still other implementations, a solar panel may supply the energy necessary to rotate the drive roller and move the gate, or alternatively supply energy necessary charge the battery.

An implementation of the gate entry system 100 may further comprise a stationary gate drive system 190 comprising a stationary roller mount 125 and a plurality of stationary rollers. The stationary gate drive system 190 is stationary in that the system remains stationary as the gate 105 is moved. The roller mount 125 may be coupled to the gate post 120, or alternatively a wall, a fence, or any other stationary object. In the implementation illustrated in FIG. 1, the roller mount 125 is coupled to an upper portion of the gate post 120. In other implementations, the roller mount 125 may be coupled to a lower portion of the gate post 120. The roller mount 125 may comprise a continuous housing with the gate post 120, or may comprise a separate housing coupled to gate post 120. Coupling of the roller mount 125 to the post 120 may comprise coupling with welding, bolting, adhesives, and the like. In still other implementations, the roller mount 125 may comprise a roller mount built into or below ground level.

The roller mount 125 may be sized to house electric wiring that travel from the post 120 through the roller mount 125. In other implementations, the roller mount 125 may house the motor and/or gears that rotate any drive rollers associated with the gate entry system 100. In still other implementations, the roller mount 125 may comprise solar panels, batteries, or other similar devices for powering the motor that drives the gate entry system 100.

The gate drive system 190 may further comprise a plurality of rollers 110, 115 that engage the gate 105 at contacting surface 180, 185. Whereas previous gate entry systems required an extra piece welded to the gate to interact with wheels or gears with an axis of rotation parallel to a plane formed by the width dimension of the gate, the rollers 110, 115 of the current disclosure comprise an axis of rotation parallel to a plane formed by the height dimension of the gate and engage directly on the gate 105 rather than any extra piece welded to the gate 105 at the installation site.

In an implementation, a first roller 110 is coupled to the roller mount 125 such that first roller 110 is in direct contact or engagement with the first contacting surface 180 of the first horizontal side 150 of the gate 105. Similarly, a second roller 115 is coupled to the roller mount 125 such that the second roller 115 is in direct contact or engagement with the second contacting surface 185 of the second horizontal side 155 of the gate 105. In the implementation illustrated in FIG. 1, the rollers 110, 115 are coupled to the roller mount 125 by bolts or motor shafts that hang from the roller mount 125. In other implementations, such as an implementation wherein the roller mount 125 is below the gate 105, the rollers 110, 115 may be coupled to the roller mount by bolts or motor shafts that rise from the roller mount 125.

In various implementations, at least one of the first roller 110 and the second roller 115 comprises a drive roller. In the particular implementation illustrated in FIG. 1, the first roller 110 comprises a drive roller while the second roller 115 comprises a passive roller. The drive or first roller 110 is responsive to a motor that rotates the first roller 110 such that the gate 105 moves in response to rotation of the first roller 110. Linear movement of the gate 105 is a result of direct contact between the first roller 110, as a drive roller, and the first horizontal side 150.

As the passive roller, second roller 115 typically only rotates in response to movement of the gate 105, movement that occurs either as result of rotation of the first (drive) roller 110, or other external forces. The passive or second roller 115 may act as a support or stabilizing roller that assists in keeping the gate 105 upright. Furthermore, the passive or second roller 115 may, in conjunction with the drive or first roller 110, create enough pressure or friction between the drive or first roller 110 and the first horizontal side 180 such that when the drive or first roller 110 is rotated and in direct contact with the first horizontal side 180, the gate moves in response to the rotation of the drive or first roller 110.

In the implementation illustrated in FIG. 1, the first 180 and second 185 contacting surfaces comprise the same surface material as the rest of the first 150 and second 155 sides, respectively. In other implementations, at least one of the first 180 and second 185 contacting surfaces may comprise a material different that the rest of the first 150 and second 155 sides of the gate 105. For example, at least one of the first 180 and second 185 contacting surfaces may comprise a material that provides greater friction between the contacting surfaces 180, 185 and the rollers 110, 115, such as a rough, uneven, or otherwise textured surface. In still other implementations, the contacting surfaces 180, 185 may comprise a series of slots that correspond with gear-like implementations of rollers 110, 115.

While the implementation illustrated in FIG. 1 comprises a plurality of rollers 110, 115 proximate only the top side 175 of the gate 105, other implementations may comprise a plurality of stationary rollers at various locations. In addition to stationary rollers near the bottom side 170, as previously mentioned, various implementations of a gate entry system may comprise a plurality of rollers proximate both the top side 175 and the bottom side 170 of the gate 105. For example, an implementation may comprise rollers 110, 115 similar to those illustrated in FIG. 1 as well as additional rollers proximate the bottom side 170. Rollers proximate the bottom side 170 may comprise passive rollers, drive rollers, or any combination thereof.

In another implementation, stationary rollers may also be positioned to directly engage the top side 175 and/or the bottom side 170 of the gate 105. Rollers of such an implementation may comprise any combination of drive and passive rollers, and may be utilized alone or in combination with other rollers disclosed throughout this document.

An implementation of a gate entry system 100 may further comprise a support wheel that supports the gate as the gate moves. In an embodiment, the support wheel comprises a guide wheel 135 coupled to the bottom side 170 of the gate 105. The guide wheel 135 may be sized and shaped to mate with a guide track 130. The track 135 may comprise a peaked track sized to fit within a groove on the guide wheel 135. Accordingly, the guide wheel 135 may roll over the guide track 130, with the guide track 130 keeping the guide wheel 135 and gate 105 on the desired path.

Figure 2:
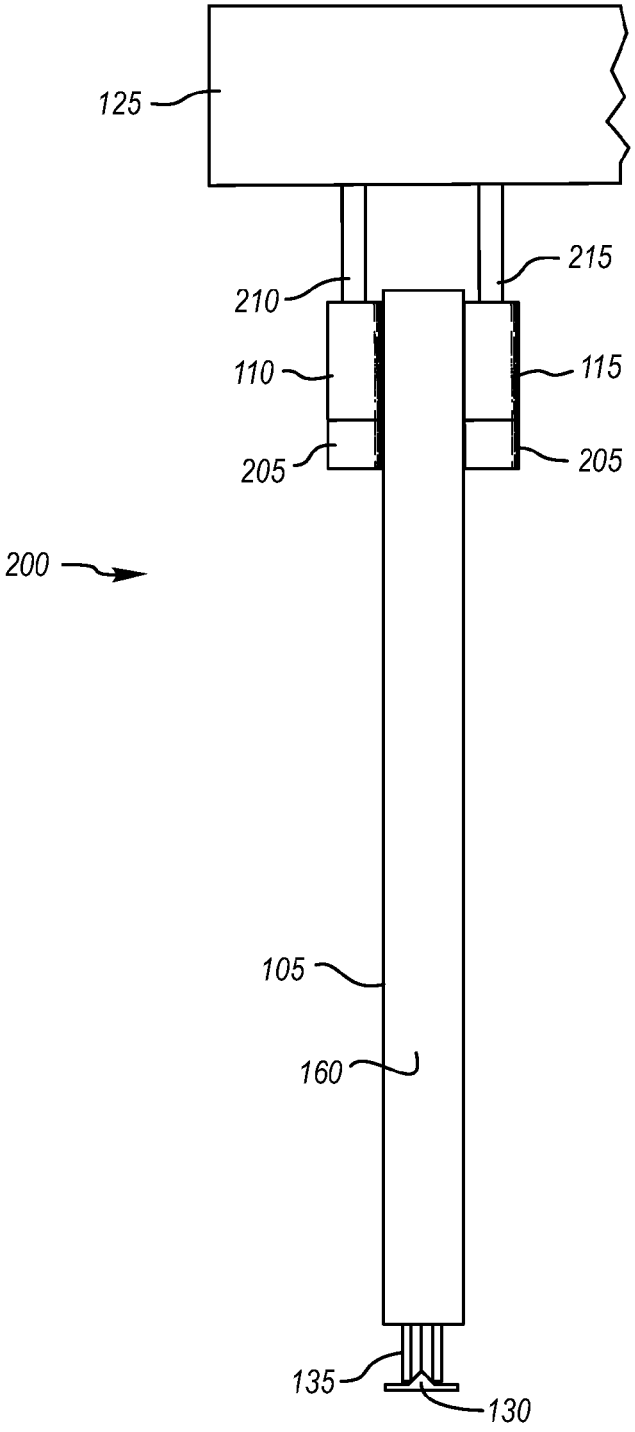
FIG. 2 is a side view of a second implementation of a gate entry system.

Referring now to FIG. 2, an implementation of a gate entry system 200 may comprise extension rollers 110 coupled to the first 110 and second 115 rollers. A plurality of rollers on each side of the gate 105, accomplished with extension rollers, is advantageous in situations when more contacting surface area is needed or preferred to move the gate 105, the gate 105 travels over an angled or inclined surface, or the gate 105 comprises an arch type design.

Rollers 110, 115 of FIG. 2 may perform in function similar to that previously described in this document. In the gate entry system 200 illustrated in FIG. 2, one extension roller 205 is coupled to each of the first 110 and second 115 rollers. Extension rollers 205 may be universal in that an extension roller 205 can couple with either a drive roller or passive roller. As shall be described in greater detail in relation to FIGS. 3-4, extension rollers 205 may be coupled to drive and passive rollers through threaded coupling. For example, both the first 110 and second 115 rollers may comprise a female threaded section sized to mate with a male threaded section on the extension rollers 205.

Once coupled to the first 110 and second 115 rollers, the extension rollers 205 may rotate responsive to rotation of the first 110 and second 115 rollers. In FIG. 2, first roller 110 comprises a drive roller coupled to the roller mount 125 with a motor shaft 210. As previously described, a motor or gears associated with the system 200 may rotate the motor shaft 210, which also rotates the drive or first roller 110. Rotation of the drive or first roller 110 also rotates the extension roller 180 coupled to the drive or first roller 110. With at least one extension roller 205 coupled to the drive or first roller 110, only one of the extension roller 205 and the drive or first roller 110 is required to be engaged with the first contacting surface 180 to move the gate 105. Thus, if the gate 105 comprised an arched gate (shown in FIG. 5) or is located on an inclined surface, engagement with the first contacting surface 180 may alternate between the drive or first roller 110 and the extension roller 205 coupled to the first roller 110.

Similarly, an extension roller 205 may be coupled to the second roller 115. If the second roller 115 is a passive roller coupled to the roller mount 125 with a bolt 215, as illustrated in FIG. 2, the extension roller 205 coupled to the second roller 115 only rotates in response to movement of the gate 105 and/or rotation of the second roller 115. If the second roller 115 comprises a drive roller, the extension roller 205 coupled to the second roller 115 performs in function similar to that previously described in relation to the extension roller 205 coupled to the first roller 110.

In other implementations, a plurality of extension rollers 205 may be coupled to each roller 110, 115. For example, it may be advantageous to couple two extension rollers 205 to each of the first 110 and second 115 rollers. In other implementations, it may be advantageous or efficient to couple at least one extension roller to only the drive or first roller 110. In such an implementation, the at least one extension roller 205 coupled to the drive or first roller 110 may provide the force or engagement necessary to move a gate 105 on an inclined surface or an arched gate, while the passive or second roller 115 may provide the force or support necessary to create sufficient engagement between the first contacting surface 180 and the rollers 110, 205 to move the gate 105. Extension rollers 205 may be used in combination with any of the rollers described in various gate entry system disclosed in this document.

In various other implementations, a gate entry system may comprise rollers partially within gate posts on opposing sides of a gate. Accordingly, a gate entry system may comprise two gate posts spaced such that the gate may fit between the gate posts. In a particular implementation each gate post comprises a concave portion or hole sized to fit a majority of the roller. Other similar implementations may comprise holes sized to fit any portion of the contacting roller. The amount or portion of the roller outside the post may be adjusted in some implementations, allowing a user or technician the ability to adjust the amount of pressure, tension, or fit of the gate between the contacting rollers. Like other implementations, the rollers may contact an contacting surface of the gate.

In a particular implementation, a gate entry system comprises a motor in one gate post that powers the drive roller built into that post. In such an implementation, the roller partially within the other post may comprise either a passive roller or a drive roller. In still other implementations, the any number of rollers may be located anywhere along the gate posts.

Though not expressly shown, various implementations of gate entry systems 100, 200 disclosed herein may comprise a release or tension lever. In an embodiment, the release lever is located just outside a channel formed to guide or hold the drive roller. The channel may extend across the entire distance travel by the gate 105, a portion of the distance, or only next to the post 120 or cabinet area. The lever may release the tension between the gate and the roller, or may act as a brake to stop the gate 105 from moving. In still other implementations, the gate entry system 100 may comprise an automatic release when power dies. Gate entry systems may comprise electric solenoid to lock the operators into an automatic mode. When the power dies in such implementations, the gate entry system releases the gate into manual mode automatically.

The motor of various gate entry systems may comprise any motor that provides energy sufficient to rotate the at least one drive roller 110. The motor may comprise a hydraulic motor, an electric motor, an air driven motor, or a pneumatic motor. The electric motor may comprise a solar, battery, electric cable, or any other variety of electric motors. In various implementations, the motor may be housed in a cabinet outside the post 120, inside the post 120, or in the roller mount 125. In an implementation, the motor or controls may be coupled to the top of the gate 120 and installed by the consumer. In particular implementations, a storage battery is used which is trickle-charged through a low voltage electric cable or solar panel.

Figure 5:
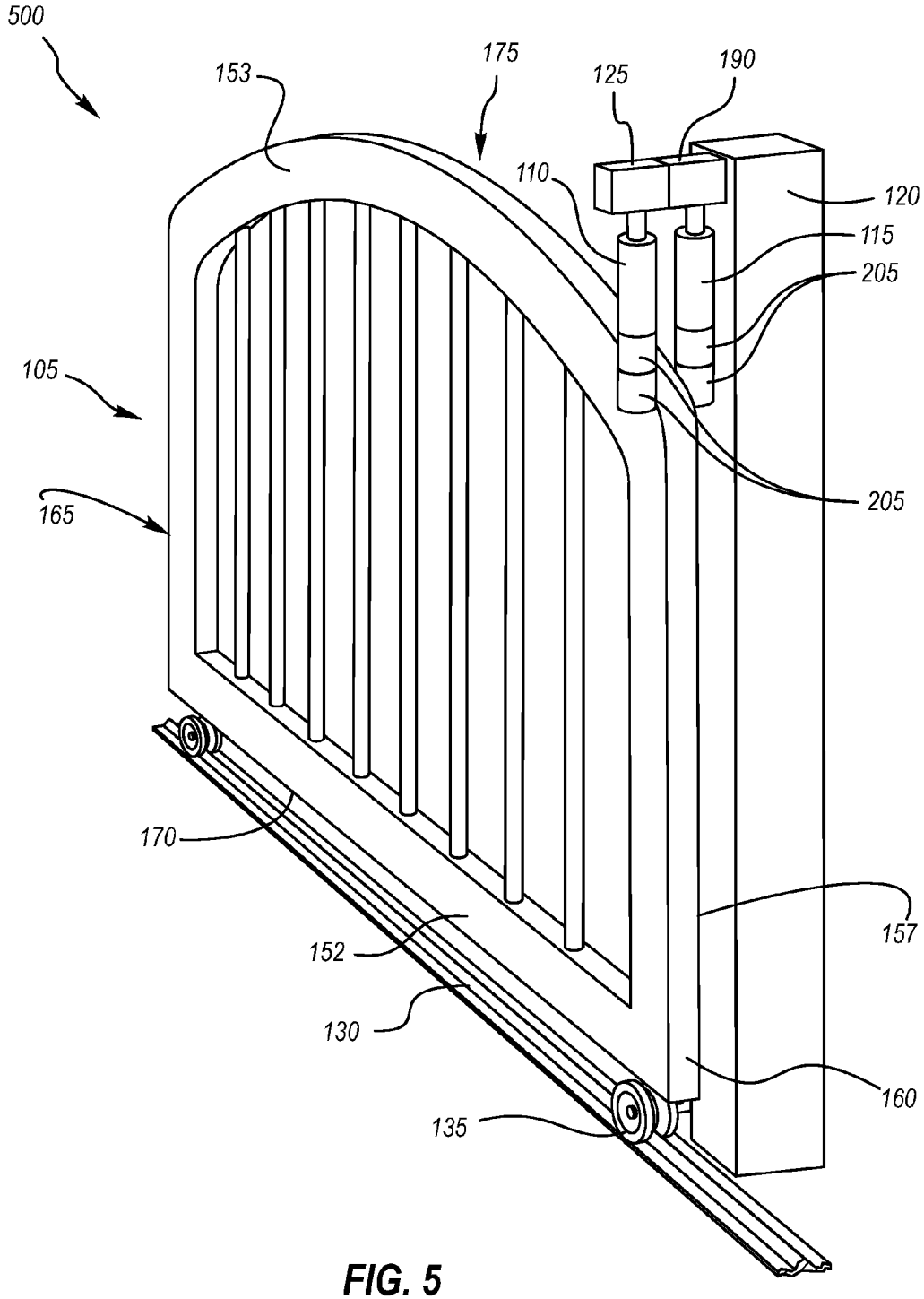
FIG. 5 is a perspective view of a third implementation of a gate entry system.

Reference is now made to FIG. 5, which illustrates one aspect of an implementation of a gate entry system with an arched gate 500. Various aspects of the arched gate 500 are similar to the gate 100 illustrated in FIG. 1. The arched gate 500 comprises at least a first side 152 and a second side 157 opposite the first side 152. Both the first 152 and second 157 sides may comprise an arched portion 153.

As is shown in FIG. 5, often times a single first roller 110 and a single second roller 115 is insufficient to keep an arched or other irregularly shaped gate in constant contact and between the two rollers 110, 115. Thus, an irregularly shaped gate may be inoperable unless additional rollers are coupled to the first 110 and second 115 rollers. Extension rollers 205 may be coupled to the first 110 and second 115 to insure each of the first 152 and second 157 sides of the arched gate 500 is always in contact with the at least one roller of the plurality of rollers 110, 115, 205. In various implementations, any number of extension rollers may be coupled to the first 110 and/or second 115 rollers.

Figure 3A:
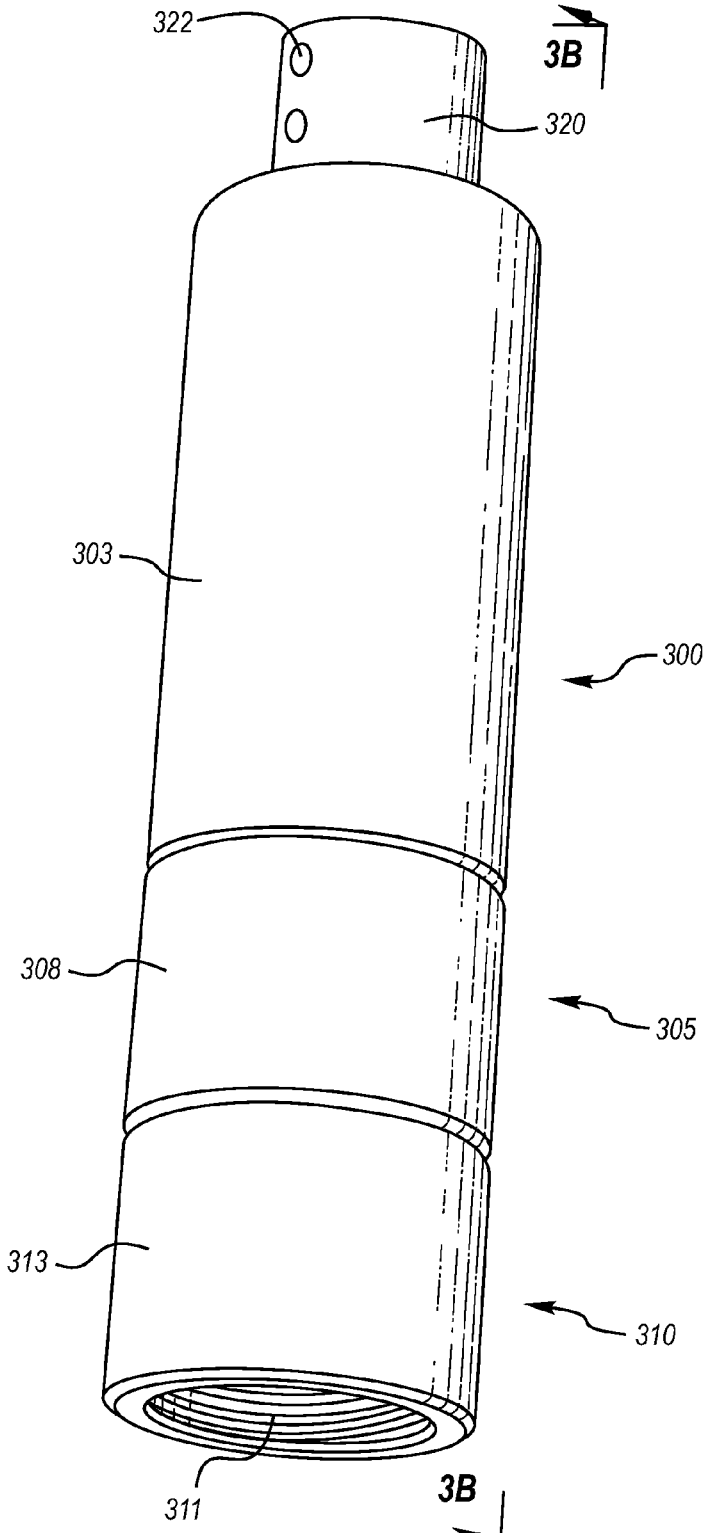
FIG. 3A is a perspective view of a drive roller and two extension rollers.
Figure 3B:
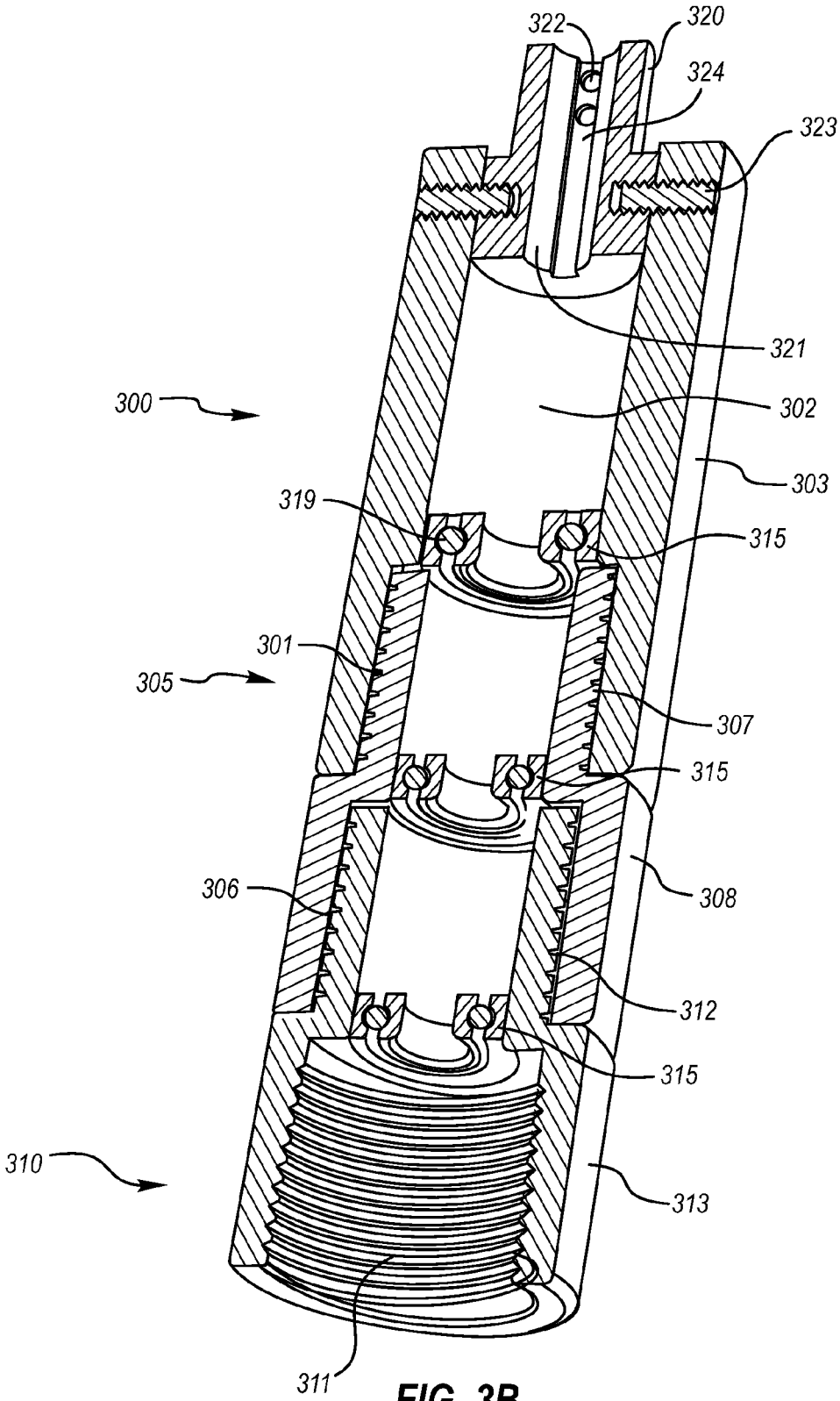
FIG. 3B is a perspective cross sectional view taken along sectional line 3B-3B in FIG. 3A of the drive roller and two extension rollers.
Figure 3C:
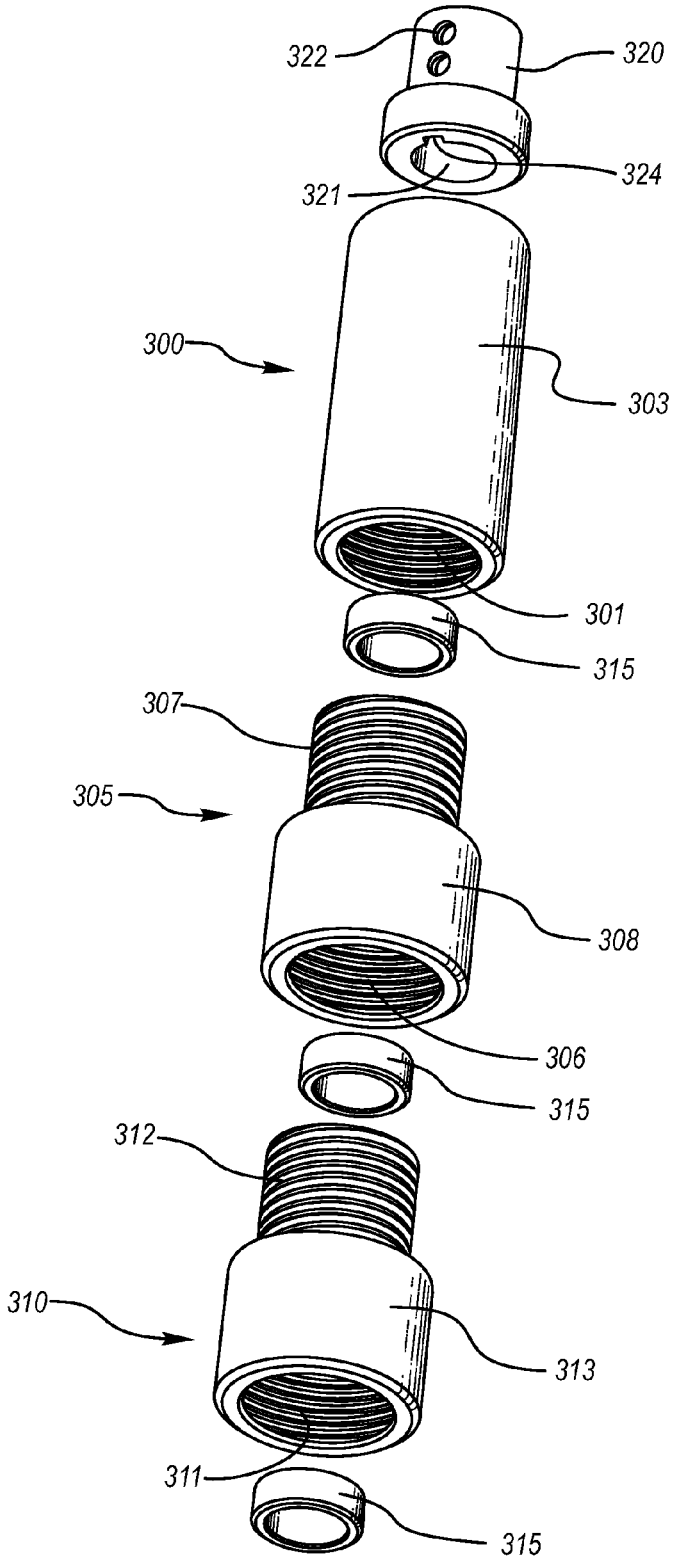
FIG. 3C is a break apart view of the drive roller and two extension rollers of FIG. 3A.

Reference is now made to FIGS. 3A-C, which illustrate various views of a drive roller 300 and extension rollers 305, 310. When coupled, both the drive roller 300 and the extension rollers 305, 310 rotate at the same rate when one or the other is rotated. Drive roller 300 or various implementations thereof may be utilized in other references to drive rollers throughout this document. For example, first roller 110 of FIG. 1 may comprise the drive roller 300. In FIG. 3A, a drive roller is shown coupled to a first extension roller 305 and a second extension roller 310. A shaft collar 320 is shown in FIG. 3A coupled to the driver roller 300. As shown, in an implementation, edges of the outside, or contacting surfaces 303, 308, 313 of drive roller 300 and extensions rollers 305, 310, may substantially abut one another. In other implementations, a space may exist between each roller 300, 305, 310, even when fully coupled.

FIG. 3B illustrates a sectioned perspective view of a drive roller 300 coupled to two extension rollers 305, 310. In the implementation shown, the three rollers 300, 305, 310 are coupled with a threaded coupling. For example, roller 300 comprises a threaded female coupling 301 on an interior surface of the drive roller 300. First extension roller 305 comprises a corresponding threaded male coupling 307. Thus, the first extension roller 305 may be screwed into the drive roller 300 to couple the first extension roller 305 to the drive roller 300.

The first extension roller 305 may further comprise a threaded female coupling 306 an interior surface of the first extension roller 305. The second extension roller 310 may comprise a corresponding threaded male coupling 312. Thus, the second extension roller 310 may be screwed into the first extension roller 305 to couple the second extension roller 310 to the first extension roller 310. In FIG. 3B, the second extension roller 310 comprises an additional threaded female coupling 311, thus allowing an additional extension roller to be screwed into to the second extension roller 310. In various embodiments, any number of extension rollers may be coupled to the drive roller 300. Furthermore, extension rollers 305, 310 may be universal or interchangeable, and may even be configured to be utilized with both a drive roller 300 and a passive roller 400. In another embodiment, the second extension roller 310 may comprise a cap or other mechanism that prevents additional extension roller coupling.

Once screwed in, set screws may be utilized to add additional strength to the coupling of the extension rollers 305, 310 and the drive roller 300. In another implementation, the extensions rollers 305, 310 and the drive roller 300 may be coupled together with only set screws, and no male-female threading sections as illustrated in FIG. 3. For example, a portion of the first extension roller 305 may fit within a portion of the drive roller 300. Once inside, a set screw that travels through both the drive roller 300 and the first extension roller 305 may be inserted to couple the drive roller 300 and the first extension roller 305. The second extension roller 310 may be coupled to the first extension roller 305 in a similar manner.

With reference to FIGS. 3A-C, the drive roller 300 may further comprise a shaft coupler. FIG. 3A illustrates a perspective view of a shaft collar 320, a drive roller 300, a first extension roller 305, and second extension roller 310 coupled together, as well as sectional line 3B-3B. FIG. 3B illustrates a perspective cross sectional view of FIG. 3A at sectional line 3. In a particular implementation, the shaft coupler comprises shaft collar 320. The shaft collar 320 may be coupled to the drive roller 300 on an end of the drive roller 300 opposite the extension roller 305. As shown in FIG. 3B, the shaft collar 320 may be coupled to the drive roller 300 with at least one set screw 323 threadedly engaged with both the shaft collar 320 and the drive roller 300. In other implements, a pin element may likewise be utilized in place of a set screw 323. Particular implementations may comprise a snap ring placed within a groove or channel on a cylindrical passage 302 through the drive roller 300. The shaft collar 320 may then be placed or rest upon the snap ring until the set screws 323 are in place. An additional snap ring may also be placed above shaft collar 320, once the shaft collar 320 is placed upon the first snap ring, thus providing additional support or stability.

The shaft collar 320 may comprise a shaft passage 321 that passes through the shaft collar 320. The shaft passage 321 may be sized or otherwise configured to house or allow a motor drive shaft or bolt to pass through the shaft passage 321. While the shaft passage 321 is typically cylindrical in shape, in various implementations, the shaft passage may comprise any shape suitable for housing or holding a shaft within the shaft passage 321. The shaft passage 321 may further comprise a coupling channel 324 that extends at partially into the shaft passage 321. In a particular implementation, the coupling channel 324 extends from one end of the shaft passage 321 to the opposing end of the cylindrical passage 321. The coupling channel 324 may comprise squared, angled, or rounded edges.

The shaft collar 320 may further comprise at least one set screw hole 322 that passes from the outside of the shaft collar 320 through the shaft collar to the shaft passage 321. As shown in FIG. 3B, in a particular implementation, the two set screw holes 322 pass from the outside of the shaft collar 320 through to the coupling channel 324 of the shaft collar 320. In other implementations, any number of set screw holes may be located on the shaft collar 320 at various locations.

Each of the drive roller 300, first extension roller 305, and second extension roller 310 may further comprise a bearing element 315. Snap rings placed within grooves in the cylindrical passage 302 of the drive roller (or other similar cylindrical passages on the extension rollers 305, 310) may hold the bearing elements 315 in a desired location within the cylindrical passage 302. Typically, a snap ring is place both above and below the bearing element 315.

As illustrated in FIGS. 3B and 3C, the bearing element 315 may comprise a hole or void sized or otherwise configured to house a drive shaft. The bearing element 315 may comprise an outer ring or portion and an inner ring or portion that rotate irrespective of the other. For example, while the outer ring remains stationary, the inner ring may rotate in either a first direction or opposing section direction. In a particular implementation, bearings 319 assist in the rotation of the inner and outer rings.

FIG. 3C illustrates an exploded perspective view of the drive roller 300, the first extension roller 305 and the second extension roller 310. As illustrated throughout FIG. 3, the drive roller 300, the first extension roller 305, and the second extension roller 310 may each comprise a contacting surface 303, 308, 313, respectively. The contacting surface 303, 308, 313 may comprise the same or different material than the rest of the drive roller 300 or extension rollers 305, 310. In the implementation shown, the contacting surfaces 303, 308, 313 comprise smooth surface. In other implementations, the contacting surfaces 303, 308, 313 may comprise rough, textured, or ribbed surfaces. In a particular embodiment, the contacting surface 303, 308, 313 comprises a rubber material, while the remainder of the drive roller comprises a metal material.

Figure 3D:
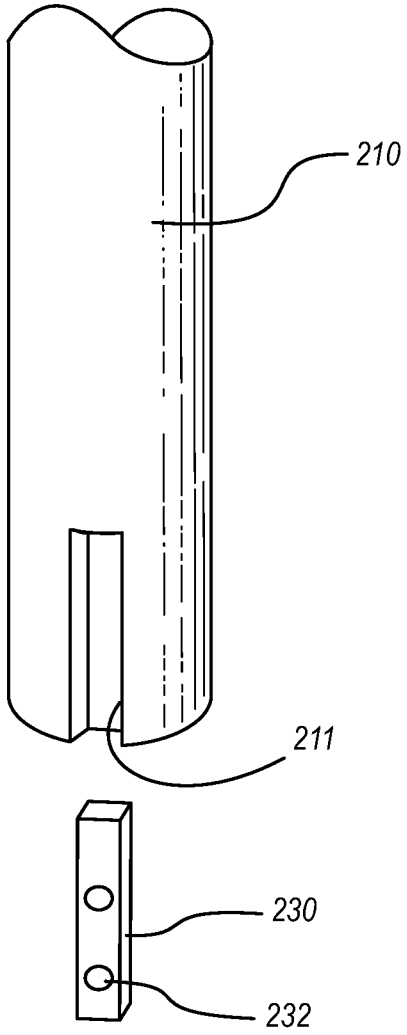
FIG. 3D is a perspective view of a portion of a drive shaft and a rod.

Reference is now made to FIG. 3D, which illustrates a particular implementation of a drive or motor shaft 210 that couples to the drive roller 300 of FIGS. 3A-C. The drive or motor shaft 210 would typically be operatively coupled to a drive motor of a gate drive system 190 (e.g. FIG. 1). This and other drive or motor shafts may comprise a shaft body sized to fit through the shaft passage 321 (FIG. 3C) on the shaft collar and a head sized larger than the shaft passage (see, similar to the example in FIG. 4B). In some implementations, the body may also be sized to pass through the hole on the bearing element 315.

The drive or motor shaft 210 may further comprise a coupling channel 211. The coupling channel 211 of the motor shaft 210 may comprise a width approximately equal to the width of the coupling channel 324 of the shaft collar 320. When the coupling channels 211, 324 of the motor shaft 210 and shaft collar 320 are aligned, a rod 230 may fit within the aligned channels 211, 324. The rod 230 may comprise at least one set screw hole 232 that passes at least partially into the rod 230. In an implementation, the set screw holes 232 on the rod may pass through the rod 230 and align with set screw hole on the coupling channel 211 of the motor shaft 210.

When the rod 230 is within the aligned coupling channels 211, 324 of the motor shaft 210 and the shaft collar 320, at least one set screw may be threadedly engaged with a set screw hole 322 on the shaft collar 320 and a set screw hole 232 on the rod 230. In other implementations, the set screw may be threadedly engaged with the shaft collar 320, the rod 230, and the motor shaft 210. Placement and/or securing of the rod 230 within the aligned coupling channels 211, 324 provides the coupling necessary for simultaneous rotation of both the motor shaft 210 and the drive roller 300. For example, when the rod 230 is within the aligned coupling channels 211, 324, when the motor shaft is rotated (by a motor or other device), the drive roller 300 rotates at the same rate.

In an implementation, the body of the motor shaft 210 is placed through motor shaft such that the head of the motor shaft 210 is within the cylindrical passage 302 of the drive roller. The head of the motor shaft, therefore, may prevent the drive roller 300 from sliding off the motor shaft 210. In other implementations, the body of the motor shaft may pass through the motor shaft and at least one bearing element, with the head of the motor shaft prevent the drive roller 300 from sliding off the motor shaft 210.

Figure 4A:
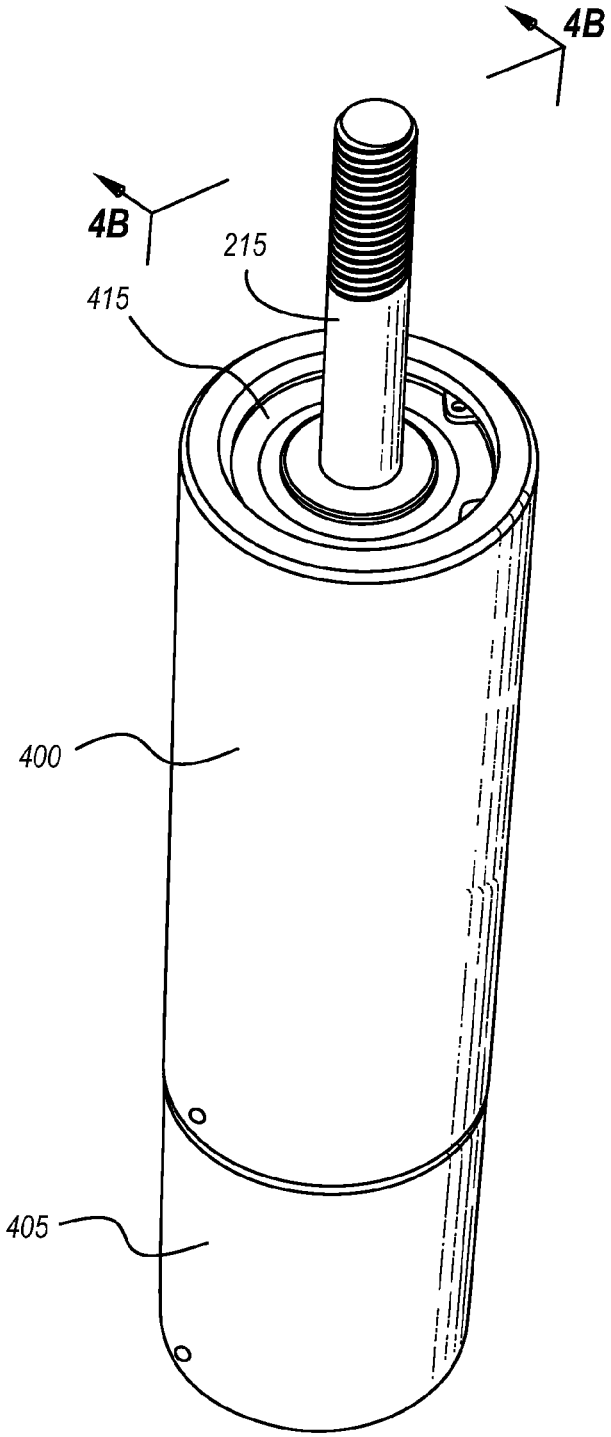
FIG. 4A is a perspective view of a passive roller and an extension roller.
Figure 4B:
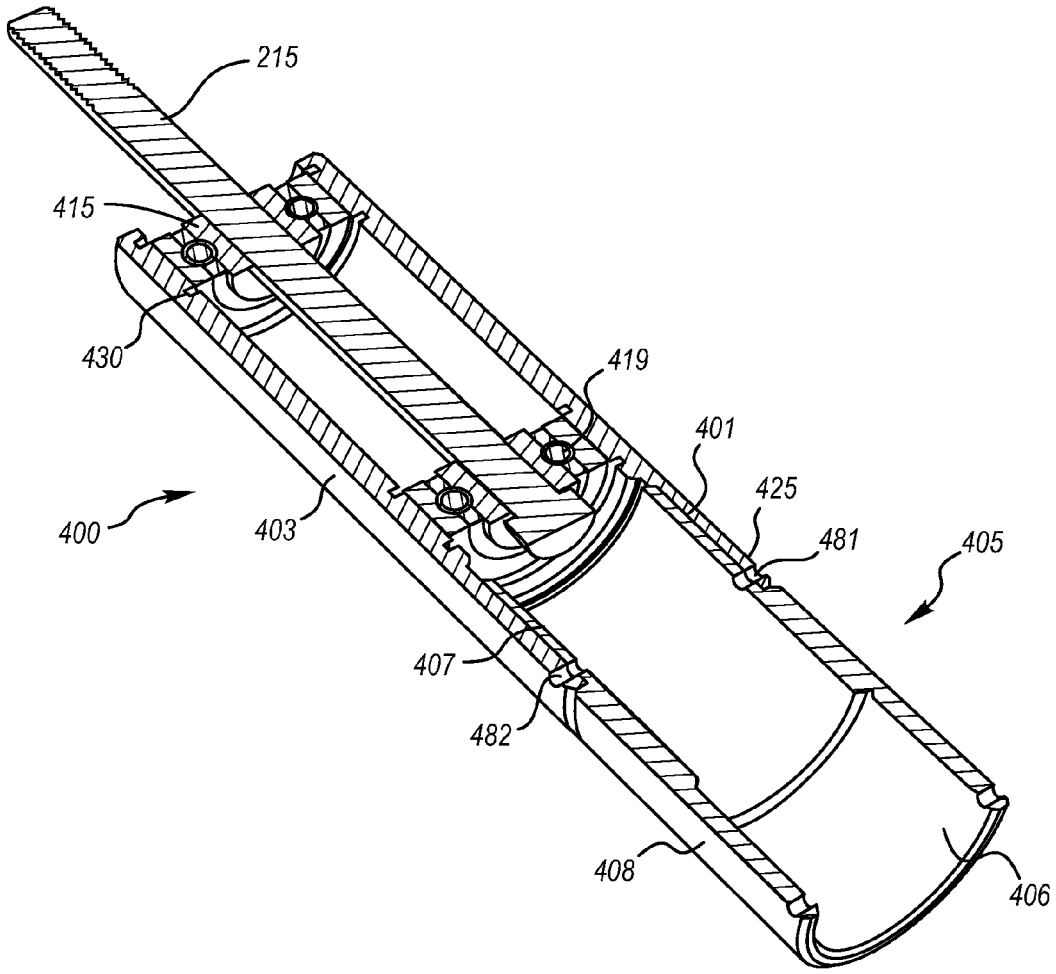
FIG. 4B is a perspective cross sectional view taken along sectional line 4 in FIG. 4A of the passive roller and extension roller.

Reference is now made to FIGS. 4A-B, which illustrate various views of a passive roller 400 coupled to an extension roller 405. FIG. 4A illustrates a perspective view of a passive roller 400 coupled to an extension roller 405, as well as sectional line 4. FIG. 4B illustrates a perspective cross sectional view of FIG. 4A along sectional line 4. When coupled, both the passive roller 400 and the extension roller 405 rotate at the same rate when one or the other is rotated. Passive roller 400 or various implementations thereof may be utilized in other references to passive rollers throughout this document. For example, second roller 115 of FIG. 1 may comprise the passive roller 400. In FIG. 4A, a passive roller 400 is shown coupled to an extension roller 405. As shown, in an implementation, edges of the outside, or contacting surface 403, 408 of passive roller 400 and extension roller 405, respectively, may substantially abut one another. In other implementations, a space may exist between each roller 400, 405, even when fully coupled. A portion of a snap ring 476 is also visible in FIG. 4A.

FIG. 4B illustrates a sectioned perspective view of a passive roller 400 coupled to an extension roller 405. In various implementations, the passive roller 400 may comprise a bolt coupling and a female coupling 401, while the extension roller 405 may comprise a male coupling 407 and a second female coupling 406. The male coupling 407 of the extension roller 405 is sized to fit within female coupling 401 of the passive roller 400. In the implementation shown, the two rollers 400, 405 are coupled with a set screw that threadedly engages with a set screw hole 481 on the passive roller 400 and a set screw hole on the extension roller 482. Other implementations may comprise a plurality of set screws threadedly engaged with a plurality of set screw holes on the passive roller 400 and the extension roller 405. Additional extension rollers may be coupled to the extension roller 405 in a similar manner. In still other implementations, a pin element may be utilized in place of a set screw.

In a particular implementation, the female coupling 401 may comprise threaded female coupling on an interior surface of the passive roller 400. The male coupling 407 of the extension roller 405 may comprise a corresponding threaded male coupling. Thus, the extension roller 405 may be screwed into the passive roller 400 to couple the extension roller 405 to the passive roller 400. In such an implementation, the extension roller 405 may be further utilized with the drive roller 300 such that extension rollers 305, 310, 405 may be used interchangeably. In various embodiments, any number of extension rollers may be coupled to the passive roller 400. In another implementation, the extension roller 405 may comprise a cap or other mechanism that prevents additional extension roller coupling.

The passive roller 400 may further comprise a bolt coupling. In a particular implementation, the bolt coupling comprises at least one bearing element 415 coupled to an interior wall of the passive roller 400. In the implementation of FIG. 4B, the two bearing elements 415 are coupled to an interior wall of the passive roller 400 with snap rings 430. The bearings 415 may be similar to the bearing elements 315 previously described. Various implementations may further comprise ball bears 419 that assist in rotation between the inner and outer rings of the bearing elements. Each of the bearing elements 415 may be configured and sized such that a shaft of a bolt or other cylindrical object may pass through the bearing elements 415. The bearing elements 415 may comprise any type of bearing element known in the art, sufficient to couple the passive roller 400 to a roller mount such that when at least one of contacting surface 403, 408 are in contact with a moving gate, the passive roller 400 rotates.

As illustrated throughout FIGS. 4A-B, the passive roller 400 and the extension roller 405 may each comprise a contacting surface 403, 408, respectively. The contacting surface 403, 408 may comprise the same or different material than the rest of the passive roller 400 or extension roller 405. In the implementation shown, the contacting surfaces 403, 408 comprise a smooth surface. In other implementations, the contacting surfaces 403, 408 may comprise rough, textured, or ribbed surfaces. In a particular embodiment, the contacting surface 303, 308, 313 comprises a rubber material, while the remainder of the drive roller comprises a metal material.

Figure 6A:
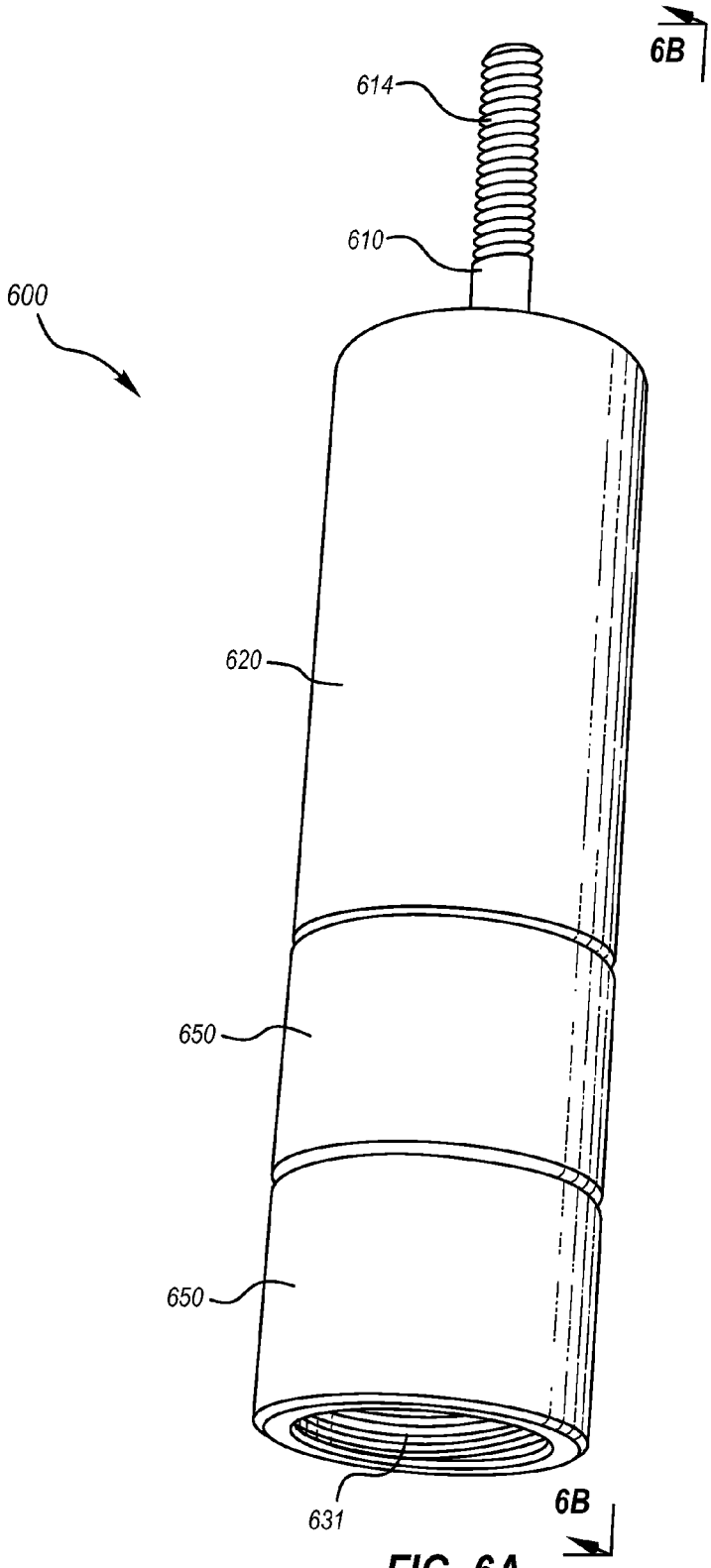
FIG. 6A is a perspective view of gate roller system.
Figure 6B:
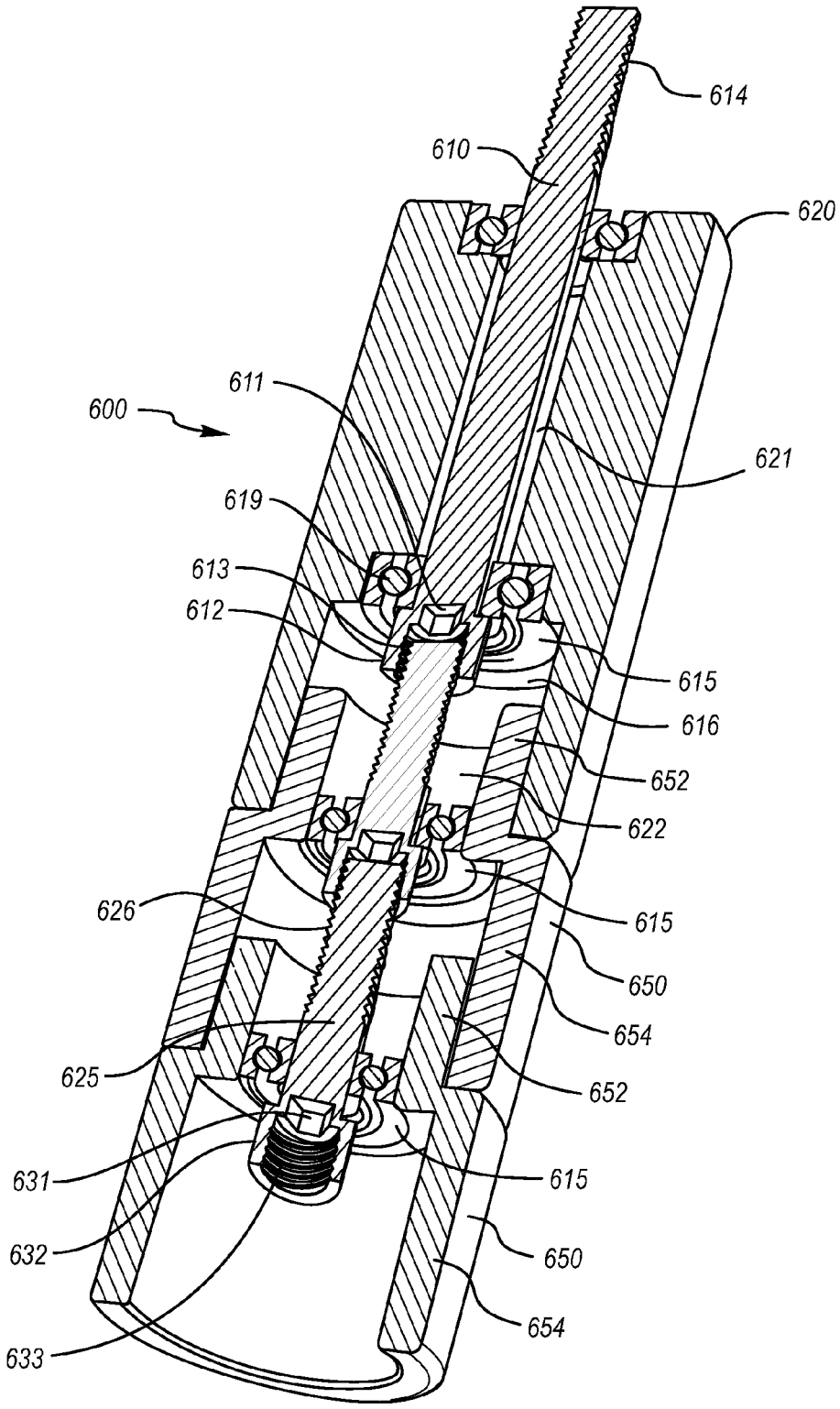
FIG. 6B is a perspective cross sectional view taken along sectional line 6 of FIG. 6A.

Reference is now made to FIGS. 6A-B, which illustrate another implementation of a gate roller system 600 or apparatus for a gate entry system. FIG. 6A illustrates a perspective view of the gate entry system and sectional line 6. FIG. 6B illustrates a perspective cross sectional view of FIG. 6A along sectional line 6. In this implementation, the gate roller system 600 comprises a main roller 620 coupled to two drive rollers 650. The main roller 620 may comprise a passage 621 sized or otherwise configured to house the shaft of a bolt 610. Likewise, each extension roller 650 may comprise a passage 622 sized or otherwise configured to house the shaft of a bolt 625. The main roller 620 and extension rollers 650 may further comprise bearing elements 615 similar to bearing elements 315, 415 previously described.

In an implementation, the main roller 620 further comprises a female coupling 616. Each of the extension rollers 650 may be comprised of a male coupling 652 and female coupling 654. In an implementation, a male coupling 652 on either of the extension rollers 650 is sized or otherwise configured to fit within either main roller 620 female coupling 616 or the extension roller 650 female coupling 654.

An implementation of the system or apparatus may further comprise a main bolt 610 located at least partially within the passage 621 of the main roller 620. In a particular implementation, the main bolt 610 comprises a head 612. The head 612 may be sized to not fit within the passage 621 of the main roller 620, or may be prevented from entering the passage 621 of the main roller 620 by a bearing element 615. The head 612 of the main bolt 610 may comprise female threaded coupling 613, and in some implementations, a hex key receiver 611 within the female threaded coupling 613. Opposite the head 612 of the main bolt 610, the main bolt 610 may comprise a male threaded coupling 614. The male threaded coupling 614 may be configured to threadedly couple with a threaded female coupling of a roller mount 125. In an implementation wherein the main roller 620 comprises a drive roller, the roller system 600 may further comprise a collar shaft coupled to the main bolt 610 and the main roller 620 similar to the collar shaft 320 described in relation to FIGS. 3A-D.

The gate roller system 600 may further comprise at least one extension bolt 625. In FIG. 6, two extension bolts 625 are shown in use with two extension rollers 650. However, in some implementations, a single extension bolt 625 may be used with a plurality of extension rollers 650. Like the main bolt 610, each extension bolt 625 may comprise a head 632 that comprises a female threaded coupling 633 and a hex key receiver 631 within the female threaded coupling. Each extension bolt 625 may further comprise a threaded male coupling opposite the extension bolt head 632.

In an implementation, the main bolt 610 may be placed or located through passage 621 of the main roller 620, with the threaded male coupling 614 extending outside the main roller 620 and the main bolt head 612 proximate the female coupling 616 of the main roller 620. A hex key may be placed within the hex key receiver 611 to rotate the main bolt 610 and threadedly engage the threaded male coupling 614 with a threaded female coupling. The male coupling 652 of an extension roller 650 may be placed or located within the female coupling 616 of the main roller 610. An extension bolt 625 may be place or located through passage 622 of the extension roller 650. The threaded male coupling 626 may be threadedly engaged with threaded female coupling 613 of the main bolt head 612. In an implementation, the threaded male coupling 626 is threadedly engaged with the threaded female coupling 613 of the main bolt head 612 by rotating the extension bolt 625 with a hex key placed within the hex key receiver 631 of the extension roller 650. Additional extension rollers may be coupled in like manner.

The components used for the gate entry system or rollers, such as those shown herein, may be made of conventional materials used to make goods similar to these in the art, such as, by non-limiting example, polycarbonate, polyvinylchloride (PVC) or other rigid or flexible rubbers, plastics, or resins, aluminum, steel, other metals, carbon fiber, kevlar, other composite materials. Those of ordinary skill in the art will readily be able to select appropriate materials and manufacture these products from the disclosures provided herein.

It will be understood that implementations are not limited to the specific components disclosed herein, as virtually any components consistent with the intended operation of a method and/or system implementation for gate entry systems and gate roller systems may be utilized. Accordingly, for example, although particular gates and rollers may be disclosed, such components may comprise any shape, size, style, type, model, version, class, grade, measurement, concentration, material, weight, quantity, and/or the like consistent with the intended operation of a method and/or system implementation for gate entry systems and gate roller systems may be used.

In places where the description above refers to particular implementations of gate entry systems and gate roller systems, it should be readily apparent that a number of modifications may be made without departing from the spirit thereof and that these implementations may be applied to other gate entry systems and gate roller systems. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A gate entry system, comprising:

a gate comprising a first horizontal side, and a second horizontal side opposite the first horizontal side, the first and second horizontal sides separated by a top side at an upper end and a bottom side at a lower end, the bottom side comprising at least one support wheel between the bottom side and a ground surface;

a gate drive system stationarily positioned relative to a gate post and comprising a roller mount coupled to the gate post, a first roller coupled to the roller mount and in direct contact with the first horizontal side, a second roller coupled to the roller mount and in direct contact with the second horizontal side;

wherein at least one of the first roller and the second roller is a drive roller responsive to at least one motor that rotatably drives the drive roller against the respective first or second horizontal side of the gate such that the gate moves linearly in response to the drive roller movement; wherein each of the first roller and the second roller comprises at least one extension roller mechanically coupled to a distal end of the respective rollers such that rotation of the respective first and second rollers rotates the at least one extension roller coupled thereto, wherein at least one of the first roller and its at least one extension is in direct contact with the first horizontal side when the gate moves and at least one of the second roller and its at least one extension is in direct contact with the second horizontal side when the gate moves.

2. The gate entry system of claim 1, wherein one of the first roller and the second roller is a passive roller, not rotatably driven by a drive motor, that passively rotates as the gate moves linearly in response to the drive roller movement.

3. The gate entry system of claim 1, wherein both the first roller and the second roller are each drive rollers responsive to the at least one motor that rotatably drives the drive rollers.

4. The gate entry system of claim 1, wherein the at least one extension roller coupled to the first roller through a threaded coupling.

5. The gate entry system of claim 4, wherein the threaded coupling comprises a threaded female coupling on an inside surface of the distal end of the first roller and a threaded male coupling on an outside surface of an end of the at least one extension roller coupled thereto.

6. The gate entry system of claim 4, wherein the threaded coupling comprises a threaded female aperture on at least one of the first roller and the at least one extension roller, and a threaded screw coupled with the threaded female aperture.

7. The gate entry system of claim 1, wherein the gate drive system further comprises at least one gear housed in the roller mount, the at least one gear rotatably responsive to the motor and configured to rotate the drive.

8. The gate entry system of claim 1, wherein the at least one support wheel is at least one guide wheel configured to remain coupled with a guide wheel track as the gate moves linearly.

9. The gate entry system of claim 1, wherein the roller mount is coupled to the gate post above the gate adjacent the top surface, and the first roller and the second roller extend below the roller mount.

10. The gate entry system of claim 1, wherein the roller mount is coupled to the gate post below the gate adjacent to the bottom surface, and the first roller and the second roller extend above the roller mount.

11. The gate entry system of claim 1, wherein at least one of the first roller and the second roller comprises:

a cylindrical drive roller comprising a shaft coupler and a threaded female coupling opposite the shaft coupler on an inside surface; and a cylindrical first extension roller comprising a first extension threaded male coupling, wherein the extension roller is coupled to the drive roller through the threaded female coupling of the cylindrical driver and the first extension threaded male coupling of the extension roller.

12. The gate entry system of claim 11, further comprising a cylindrical second extension roller coupled to the first extension roller through a second extension male coupling on the second extension roller and a first extension threaded female coupling on the first extension roller opposite the first extension threaded male coupling.

13. The gate entry system of claim 12, wherein the shaft coupler comprises a shaft collar coupled to the cylindrical drive roller, the shaft collar comprising a shaft passage and a first coupling channel.

14. The gate entry system of claim 13, wherein the shaft coupler is coupled to the drive roller with at least one set screw.

15. The gate entry system of claim 14, further comprising:

a drive shaft coupled to the shaft collar and extending through the passage of the shaft collar, the drive shaft comprising a body sized to fit within the passage, a head larger than the passage, and a second coupling channel on the body; and a rod placed within first and second channels when the first and second channels are in an aligned position.

16. The gate entry system of claim 1, wherein at least one of the first roller and the second roller comprises:

a cylindrical passive roller comprising a bolt coupling, a female coupling opposite the bolt coupling, and at least one first set screw hole on the female coupling; and a cylindrical first extension roller comprising a first extension male coupling within the female coupling of the passive roller and comprising at least one second set screw hole, wherein a set screw threadedly engaged with the first set screw hole and the second set screw hole couples the passive roller to the first extension roller.

17. The gate entry system of claim 16, wherein the bolt fastener comprises at least one bearing coupled to an interior surface of the cylindrical passive roller between two snap rings, the bearing comprising a void sized allow passage of a bolt shaft of a bolt through the void.

18. The gate entry system of claim 1, wherein each of the first roller and the second roller respectively comprise:

a first gate roller comprising a first passage through the first gate roller;

a first bolt comprising a first bolt shaft body that passes through the first passage of the first gate roller, a first bolt head, and a first roller mount coupling opposite the head, wherein the first bolt head comprises a first female threaded coupling and a first hex key receiver within the first female threaded coupling; and a second gate roller comprising a second passage through the second gate roller;

a second bolt coupled to the first bolt and comprising a second bolt shaft body that passes through the second passage of the second gate roller, a second bolt head, a male threaded coupling opposite the second bolt head and threadedly coupled to the first female threaded coupling, wherein the second bolt head comprises a second female threaded coupling and a second hex key receiver within the second female threaded coupling.

19. The gate entry system of claim 18, wherein the first bolt further comprises a first coupling channel and the gate roller system further comprises:

a shaft collar coupled to the first gate roller, the shaft collar comprising a collar passage and a second coupling channel aligned with the first coupling channel; and a rod within the aligned first and second coupling channels.

* * * * *